United States Patent [19]

Dimmick et al.

[11] Patent Number: 4,805,426

[45] Date of Patent: Feb. 21, 1989

[54] LOCKING DEVICE

[75] Inventors: Gary S. Dimmick, Pittsburgh; Scott G. Lockerman, Sewickley, both of Pa.

[73] Assignee: Lockman Products Company, Inc., Pittsburgh, Pa.

[21] Appl. No.: 78,106

[22] Filed: Jul. 27, 1987

[51] Int. Cl.[4] ..... F05B 73/00

[52] U.S. Cl. ..... 70/14; 70/22; 70/29; 70/53; 70/59; 70/18

[58] Field of Search ..... 70/14, 22, 24, 27, 30, 70/49, 53, 58–60, 29, 18, 428; 59/78, 79.3, 86–89

[56] References Cited

U.S. PATENT DOCUMENTS

| | | | |
|---|---|---|---|
| 200,990 | 3/1878 | Deraismes | 70/49 |
| 486,256 | 11/1892 | Leehey | 70/49 |
| 599,765 | 3/1890 | Chase | 70/30 |
| 1,025,284 | 5/1912 | Lybeck | 70/428 |
| 1,222,920 | 4/1917 | Blais | 70/30 |
| 1,267,894 | 5/1918 | Olson | 70/30 |
| 1,472,206 | 10/1923 | Burkle | 70/30 |
| 1,627,462 | 5/1927 | Rohmer | 70/30 |
| 1,632,338 | 6/1927 | Horton | 70/14 |
| 1,857,399 | 5/1932 | Piagneri | 70/27 |
| 3,611,760 | 10/1971 | Mother | 70/18 |
| 3,906,758 | 9/1975 | Hurwitt | 70/30 |
| 4,064,715 | 12/1977 | Hodgson | 70/30 |
| 4,302,955 | 12/1981 | Kawakami | 70/30 |
| 4,398,403 | 8/1983 | Menick | 70/58 |
| 4,490,997 | 1/1985 | Hughes | 70/18 |
| 4,543,806 | 10/1985 | Papandrew | 70/30 |
| 4,597,273 | 7/1986 | Reichenberger | 70/30 |
| 4,682,481 | 7/1987 | Dimmick | 70/14 |

*Primary Examiner*—Robert L. Wolfe
*Attorney, Agent, or Firm*—Buchanan Ingersoll

[57] ABSTRACT

A conventional barrel-type combination lock receives a lock element extending from a safety pin housing. The safety pin housing pivotally receives a pin that pivots between an open position and a closed position relative to the safety pin housing, and the lock element of the barrel-type combination lock is moved to the locked position, the end of the pin is positioned within a pin receiving recess on the barrel-type combination lock so that the pin is locked in the closed position. A conventional chain formed from a series of interlocking links is utilized with the lockable safety pin to enable small articles to be locked to fixed objects. When the chain is not in use, it is stored within a cylindrical chain storage container that is threadedly received upon the end of the barrel-type combination lock. With the pin closed and the combination lock in the locked position, and with the chain positioned within the storage container theaded onto the lock, the personal locking device is of a size convenient for carrying in a purse or pocket of the potential user.

20 Claims, 3 Drawing Sheets

LOCKING DEVICE

BACKGROUND OF THE INVENTION

1. Field of the Invention

This invention relates to an apparatus for locking personal items to secure them from theft, and more particularly to a locking safety pin-like unit in combination with a chain for locking personal articles to a fixed object to prevent theft.

2. Description of the Prior Art

Many efforts have been made to provide locking devices with which to secure small articles of personal property such as purses, briefcases, coats, skis, and other personal items where circumstances demand that they be left unattended for a period of time. A common locking device of this type is a chain and padlock used to prevent the theft of an unattended bicycle.

A known device for securing smaller personal articles is disclosed in the U.S. Pat. No. 3,611,760 and consists of a combination lock and a cable which may be utilized to secure a briefcase to a fixed object. Combination cable locks are well known and the following U.S. Pat. Nos. are representative of this type of lock: 1,222,920; 1,267,894; 1,472,206; 1,627,462; 3,906,758; 4,064,715; 4,398,403; 4,543,806; and 4,597,273. Earlier known devices utilizing combination chains and lockable pins are disclosed in U.S. Pat. Nos. 200,990; 599,765, and 1,632,338.

While locking devices are well known, none of the known devices permit small articles to be locked universally to fixed objects. In most cases the construction of the known locks limits their use to specific applications and are generally cumbersome. Therefore, there is need for a locking device that may be utilized to universally attach small articles to a fixed or stationary object.

SUMMARY OF THE INVENTION

In accordance with the present invention, there is provided a locking device that includes a lock having a housing with a pin receiving recess formed therein. A lock element is slidably received within the lock housing. The lock element is movable relative to the lock housing between a locked position and an unlocked position. A pin housing is connected to the lock element. A pin is pivotally retained on the pin housing for movement between an open position and a closed position. The lock element is movable relative to the lock housing when the pin is in an open position. The lock element is fixed relative to the lock housing in the locked position when the pin is received within the pin receiving recess to lock the pin in a closed position. A length of chain is provided for wrapping around a fixed object. The chain is formed of a plurality of interconnecting links. A slide member has a bore therethrough. The chain extends through the bore and from the slide member to form a loop extending from the slide member. The pin in the closed position extends through the slide member to secure the slide member to the pin housing.

Further in accordance with the present invention, there is provided a locking device that includes a lock housing having a pin receiving recess formed in one end thereof. A lock element is slidably received within the lock housing and is movable relative to the lock housing between a locked position and an unlocked position. A pin housing is connected to the lock element and spaced from the lock housing. A pin is carried by the pin housing for movement between an open position and a closed position. The lock element together with the pin housing is movable relative to the lock housing for positioning of the pin in the pin receiving recess to secure the lock housing in the locked position and the pin in a closed position. A length of chain formed of a plurality of interlocking links is provided. A chain choke has a bore therethrough for receiving the chain. One end of the chain is secured to the chain choke and extends therefrom through the bore to form a loop of a preselected size extending from the chain choke. Means extending through the chain choke engages the chain in the bore to prevent movement of the chain in the bore to maintain the size of the loop extending from the chain choke.

Additionally, in accordance with the present invention, there is provided a method for locking a lightweight portable object to a structure that includes the steps of securing a length of chain in a loop around the structure. A slide member is advanced along the length of chain to close the loop to a preselected size around the structure. A lockable safety pin passes through an aperture in the object. The lockable safety pin passes through the slide member. The lockable safety pin passes through at least one link of the chain. Thereafter the lockable safety pin is locked to prevent slidable movement of the slide member on the chain to maintain the preselected size of the loop around the structure.

Accordingly, the principal object of the present invention is to provide a convenient, self-contained personal locking device for securing small articles to fixed objects.

Another object of the present invention is to provide a personal locking device which can be easily carried in a pocket or purse and used in a versatile manner to secure in a locked position a variety of personal objects to prevent theft or unauthorized use of the object.

A further object of the present invention is to provide a personal locking device that includes a pivotal pin movable into and out of a locked position and secured in a locked position by a barrel combination lock where a choke is utilized with a chain connected to the pin in a locked position to securely attach a chain to an object to prevent theft or unauthorized use of the object.

A further object of the present invention is to provide a pivotal pin that is movable into and out of a locked position in a barrel combination lock and associated with a combination chain and choke for versatile use in closing in a locked position an object that is capable of being opened and closed or securing a portable object to a fixed object to prevent theft.

These and other objects of the present invention will be more completely disclosed and described in the following specification, the accompanying drawings, and the appended claims.

DESCRIPTION OF THE PREFERRED EMBODIMENT

Figure 1:
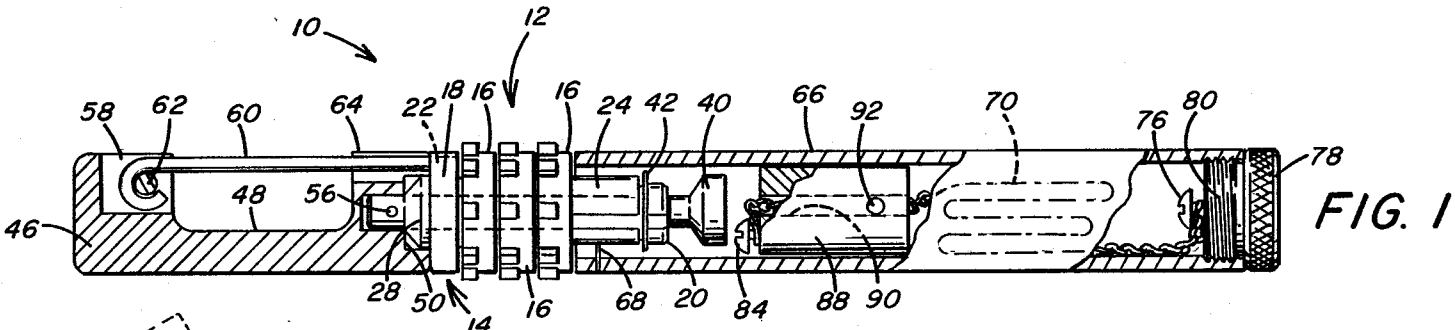
FIG. 1 is a crosssectional view of a personal locking device, illustrating a pivotal pin locked by a barrel combination lock in a closed position.
Figure 2:
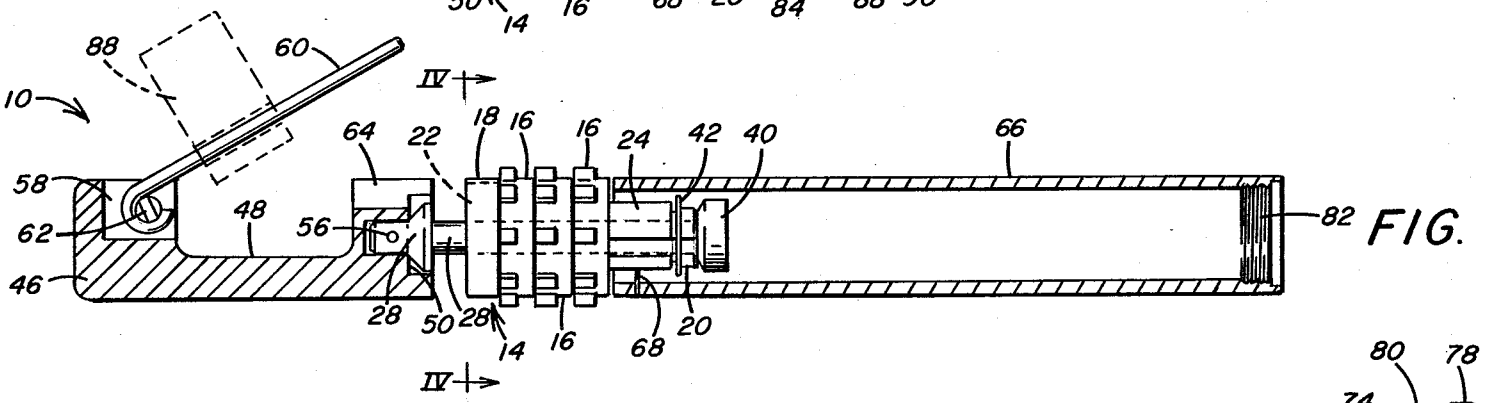
FIG. 2 is a view similar to FIG. 1, illustrating the pin moved to an open position, illustrating a choke shown in phantom on the pin.
Figure 3:
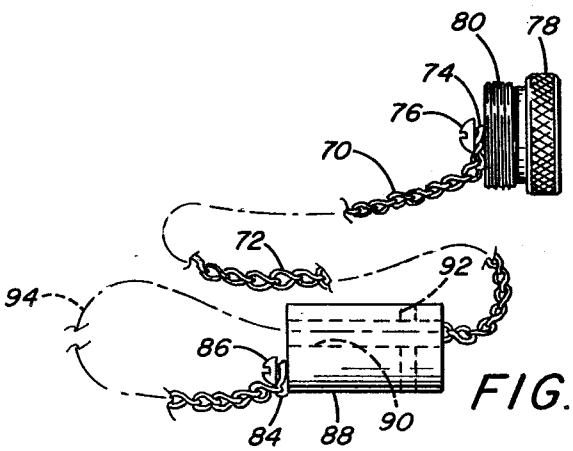
FIG. 3 is an elevational view of a length of a link chain that is stored in a storage container of the locking device as shown in FIG. 1, illustrating a cap for closing the storage container secured to one end of the chain and the choke.
Figure 4:
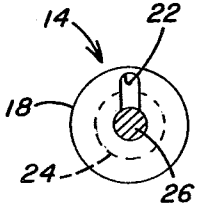
FIG. 4 is a sectional view taken along line IV-IV of FIG. 2, illustrating the barrel of a combination lock shown in FIGS. 1 and 2.
Figure 5:
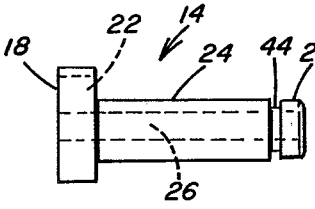
FIG. 5 is a view in side elevation of the barrel shown in FIG. 4.
Figure 6:
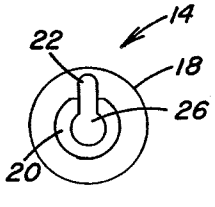
FIG. 6 is an opposite end view of the barrel shown in FIG. 5.

Referring to the drawings and particularly to FIGS. 1–3, there is illustrated a personal locking device generally designated by the numeral 10 having a barrel-type combination lock 12 which corresponds to the combination lock disclosed in copending U.S. application Ser. No. 874,220 entitled "Personal Locking Device". Known barrel-type combination locks are also disclosed in U.S. Pat. Nos. 1,222,920; 1,267,894; 1,472,206; and 1,627,462.

In conventional fashion, the lock 12 has a barrel 14 upon which are received a plurality of tumbler rings or wheels 16. As well known the tumbler wheels 16 have internal recesses (not shown) so that when the recesses are aligned, the lock 12 is in an open position. When the recesses are not aligned, the lock 12 is in a locked position in a manner well known in the art. The tumbler wheels 16 have numerals (not shown) around the circumference of each wheel 16 so that when the recesses are aligned the numerical combination of the lock 12 appears in alignment on adjacent tumbler wheels 16 in conventional fashion. Even through the above described combination lock 16 is described for use with the present invention, it should be understood that other types of locks, such as conventional key locks, are equally adaptable to the present invention.

The barrel 14 includes an enlarged end portion 18 and a reduced end portion 20. A pin receiving recess 22 extends through the enlarged end portion 18. Extending between the enlarged end portions 18 and 20 is an arbor portion 24 which includes a longitudinal bore 26 that extends downwardly from the top of the arbor 24. The bore 26 extends from the pin receiving recess 22 to the reduced end portion 20.

A lock element 28 is positioned in the bore 26 of the barrel 14 and moves in sliding, axial relation to the barrel 14 between the locked position shown in FIG. 1 and the unlocked position shown in FIG. 2. Again, in conventional fashion, when the tumbler wheels 16 are positioned so that the lock 12 is in the open position, the lock element 28 is freely slidable in the barrel bore 26 from the position shown in FIG. 1 to the position shown in FIG. 2.

Figure 9:
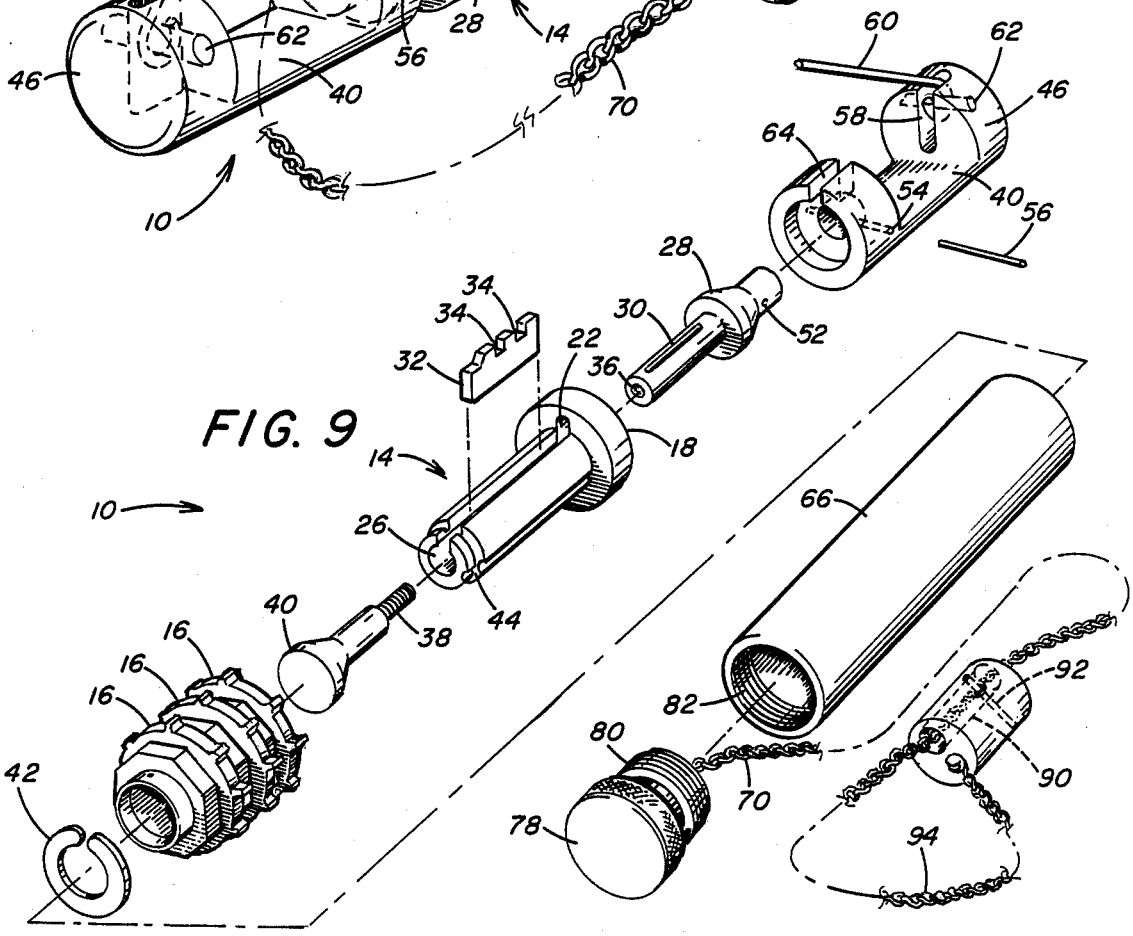
FIG. 9 is an exploded isometric view of the locking device, illustrating the components of the barrel-type combination lock, storage container and chain attached to the choke and storage container cap.

The lock element 28, as shown in greater detail in FIG. 9, includes a longitudinally extending slot 30 for receiving a key 32. The lock element 28 extends into the arbor bore 26 with the slot 30 vertically aligned with the opening through the arbor 24 which communicates with the bore 26. The key 32 extends down through the opening in the arbor portion 24 and is received within the lock element slot 30. The key 32 includes a plurality of spaced apart recesses 34. In order to lock the combination lock 12, the lock element 28 is moved to the position shown in FIG. 1. Then the tumbler wheels 16 are rotated. In the locked condition, the tumbler wheels 16 enter the key recesses 34 and prevent the lock element 32 from moving.

The lock element 28 includes at one end, as shown in FIG. 9, an internally threaded bore 36 for receiving the threaded end 38 of a stop member 40. As shown in FIGS. 1 and 2, the stop member 40 is movable toward and away from the reduced end portion 20 of the barrel 14. The stop member 40 prevents the lock elements 28 from being completely withdrawn from the barrel 14. Also as shown in FIGS. 1 and 2, the tumbler wheels 16 are maintained axially fixed on the arbor portion 24 of the barrel 14 by an external snap ring 42 which is received within a circumferential groove 44 separating the reduced end portion 20 from the arbor portion 24 of the barrel 14.

Figure 7:
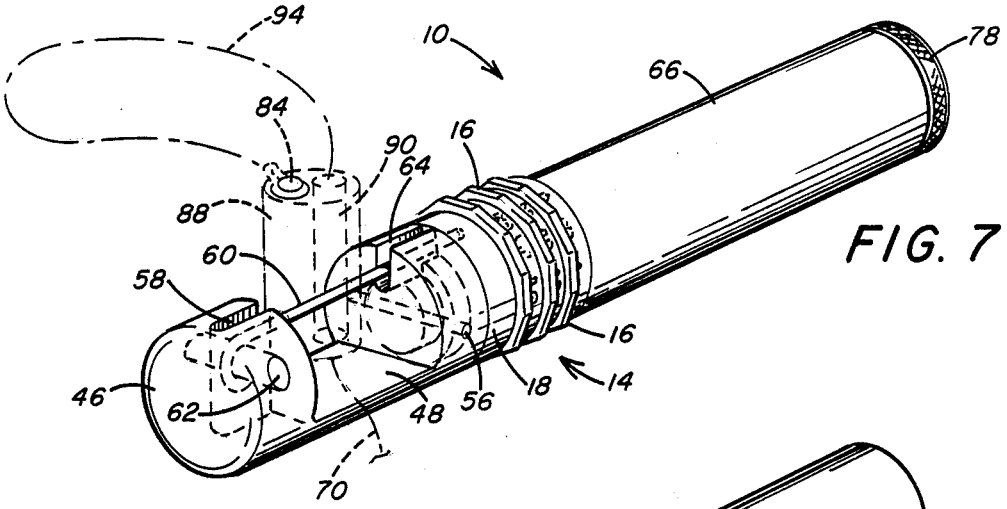
FIG. 7 is an isometric view of the locking device, illustrating the pin in a locked position and the choke shown in phantom secured to the pin.
Figure 8:
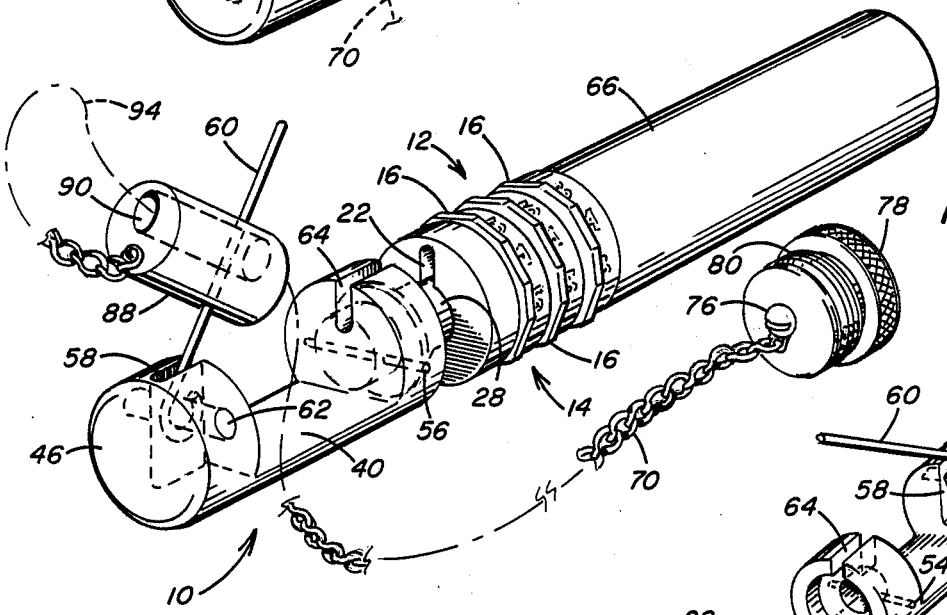
FIG. 8 is a view similar to FIG. 7, illustrating the pin in an unlocked position and the choke positioned on the pin where the chain extends through a bore in the choke and is engaged by a transverse pin.

Affixed to the opposite end of the lock element 28 is a safety pin housing 46 which is of generally cylindrical shape and has a recess 48 formed therein. As shown in FIG. 7 and 8, the safety pin housing 46 includes an opening 50 for receiving the enlarged end of the lock element 28. The lock element 28 includes a transverse boer 52 which when aligned with a transverse bore 54 in the pin housing 46 receives a pin 56 for securing the lock element 28 to the pin housing 46.

The safety pin housing 46 also includes a groove 58 formed to receive the pivoted end of a pin 60. The pin 60 is movably retained on the housing 46 by pivotally connecting the pin 60 to the housing 46 by a pivot 62 retained on the outer end of the housing 46. The housing 46 also has a pin receiving groove 64 to receive the free end of pin 60 when the pin 60 is in the closed position in the barrel pin receiving recess 22, as shown in FIGS. 1 and 7.

Referring to FIGS. 1 and 7, when the pin 60 is closed the free end of the pin 60 fits into the pin receiving groove 64 of the housing 46. Also, a portion of the pin protrudes beyond the safety pin housing 46 and into the pin receiving recess 22 of barrel 14. In this position of the pin 60 the lock element 28 is in the locked position (FIGS. 1 and 7). Thus the pin 60 is locked in a closed position and may not be opened. When the lock element 28 is moved to the open position (FIGS. 2 and 8), the end of the pin 60 is withdrawn from the pin receiving recess 22 and may be pivoted about pivot 62 to the open position.

A cylindrical chain storage container 66 is received on the end of the barrel 14 opposite from the safety pin housing 46. The storage container 66 is connected to the barrel 14 by one or more rivets 68 extending transversely through the body of the container 66 and into engagement with the body of the barrel 14. The rivet 68 in the barrel 14 does not obstruct movement of the lock element 28 in the barrel bore 26. Preferably, the pins are so materially constructed that in the event an attempt is made to break open the locking device, the storage container 66 will snap off from the barrel 14, leaving the combination lock 12 undamaged and the locking device maintained in the locked position. The cylindrical chain storage container 64 is preferably formed of metal or a rigid plastic and similarly the other components are formed of metal or a rigid plastic.

A chain 70 is provided for use as part of the personal locking device 10. When the locking device 10 is not in use, the chain 70 is stored within the storage container 64 as shown in FIG. 1. The chain 70 is formed from a plurality of individual interlocking links 72 in conventional fashion. In one embodiment (not shown) the chain 70 is a single continuous loop as illustrated in the above referenced copending application Ser. No. 874,220. In the embodiment shown in FIG. 3, a length of the chain 70 is provided with a first end portion 74 connected by a screw 76 to a knurled cap 78. The cap 78 is provided with an externally threaded portion 80 adapted to threadedly engage the internal threads 82 with in the outer end of the storage container 66. When the chain 70 is not in use, it is retained within the container 66 by threading the cap 78 onto the end of the container 66 as shown in FIG. 1.

The chain 70 includes a second end portion 84 which is connected by a screw 86 to a choke or slide member 88. Preferably, the choke 88 is cylindrical in diameter to facilitate retention and ease of movement into and out of the storage container 66, but it should be understood that the choke 88 may be of any desired configuration that will permit it to be inserted and removed from the storage container 66. The choke 88, as shown in FIGS. 3, 8 and 9 includes a longitudinal bore 90 which intersects with a transverse bore 92.

The chain 70 extends from its connection at end portion 84 from the choke 88 and through the longitudinal bore 90. With this arrangement connection of the chain 70 at one end to the choke 88 and extension of the chain through the choke bore 90 forms a loop 94 that extends from the choke 88. Accordingly, the size of the loop 94 is adjustable by pulling the chain in either direction through the bore 90. When the locking device 10 is in a locked position and the chain 70 is stored within the storage container 66, as shown in FIG. 1, the entire locking device 10 has an overall length of approximately seven inches and has a diameter of approximately one inch. It is lightweight and may be readily carried in the purse or pocket of the user until the device is needed.

In the locked position, as shown in FIG. 1, the locking device 10 can be used without the chain 70 or the choke 88. When it is desired to use the choke with the locking device 10, the device 10 is unlocked, as shown in FIG. 2, to permit the pin 60 to be pivoted out of the pin receiving groove 64. The choke 88 is then positioned on the pin 60 by extending the pin 60 through the choke transverse bore 92. This arrangement is also shown in FIG. 7 where the choke 88 is positioned on the pin 60 in a closed position. In FIG. 8 the choke 88 is shown on the pin 60 in the open position.

When the choke 88 is positioned on the pin 60, not only does the pin 60 pass through the choke transverse bore 92, but as the pin 60 intersects the longitudinal bore 90 of the choke 88, it extends through the opening in one of the chain links 72. With the pin engaging one of the chain links 72 in the chain cannot be moved in the bore 90. Thus the size of the chain loop 94 is maintained.

In operation, the size of the loop 94 is selected. Then the pin 60 is passed through the transverse bore 92 and through the chain link 72 opposite the bore 92 within the bore 90. In this manner, the choke 88 is connected to the locking device 10, and the size of the loop 94 in the chain 70 extending from the choke 88 is maintained.

Figure 10:
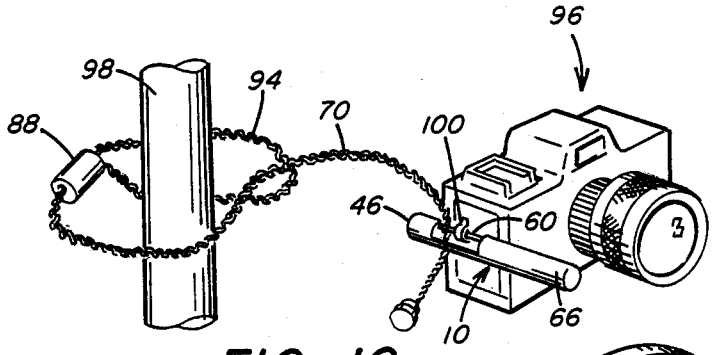
FIG. 10 is a perspective view of the locking device connected to a camera, illustrating the chain connected to the locking device and secured around a stationary object.

FIG. 10 illustrates one example of use of the locking device 10 to lock a personal item, such as a camera 96, to a stationary object, such as a post or pole 98. First, the loop 94 is formed in the chain 70. The opposite free end of the chain with the cap 78 attached thereto is extended around the post 98 and through the loop 94. Preferably, the post 98 does not have an exposed upper end portion which would allow the chain to be easily removed. One example would be a long pole or light standard where one end is secured in the ground and the other end is at such a height which would discourage removal of the chain from the post 98.

The opposite end of the chain 70 with the cap 78 secured thereto is engaged by the pin 60 when the pin is in the open position, as shown in FIG. 2. The free end of the pin 60 when in the open position is passed through one of the links 72 and is also extended through an eyelet 100 that extends from the side of the camera 96. The eyelet 100 is commonly used to attach a strap to the camera 96. Then the pin 60 is moved to the closed position and the lock element 28 is locked. In this manner, the camera 96 is locked to the locking device 10 and the chain 70 which is secured to the post 98 is also locked to the locking device 100 to thereby secure the camera 96 to the post 98.

FIG. 8 illustrates a similar example of use of the locking device 10 to secure a garment, such as a coat 102, to a doorknob 104. First, the loop 94 is extended over the doorknob 104, and the choke 88 is advanced on the chain 70 to reduce the size of the loop 94 so that it cannot be removed from the doorknob 104. Then, with the choke 88 maintained in this position, the pin 60 is passed through the transverse bore 92 of the choke 88 intersecting one of the chain links 72 in the portion of the chain 70 that extends through the choke longitudinal bore 90. The coat 102 is then secured to the pin 60 by passing the unlocked pin 60 through a hole 106 in the collar of the coat 102. The pin 60 is then inserted, as above described, in the pin receiving recess 22 to lock the pin 60 in the closed position. Thus, the chain 70 and the coat 102 are locked to the locking device 10.

Figure 11:
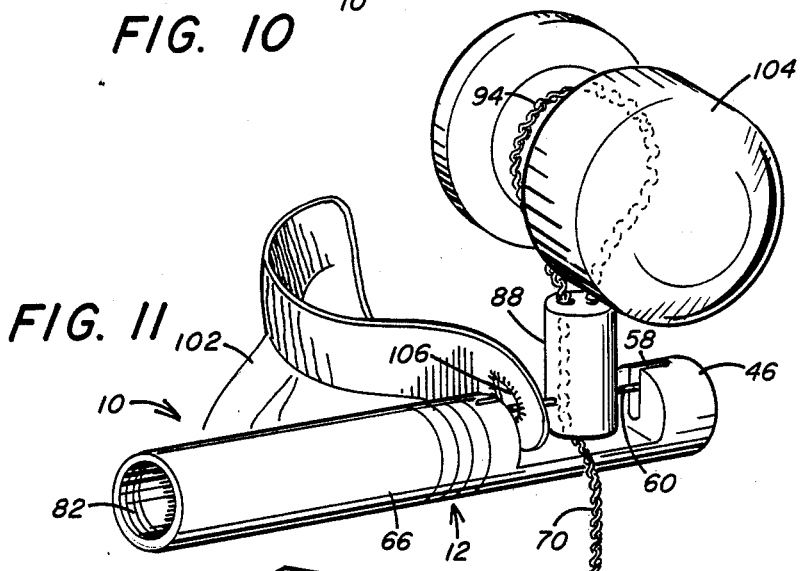
FIG. 11 is a perspective view of the locking device, illustrating the locking of an article of clothing to a doorknob.
Figure 12:
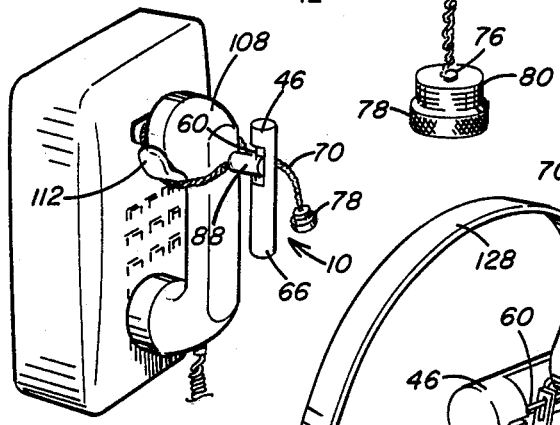
FIG. 12 is a perspective view of the locking device, illustrating a telephone secured in a manner to prevent its use.
Figure 13:
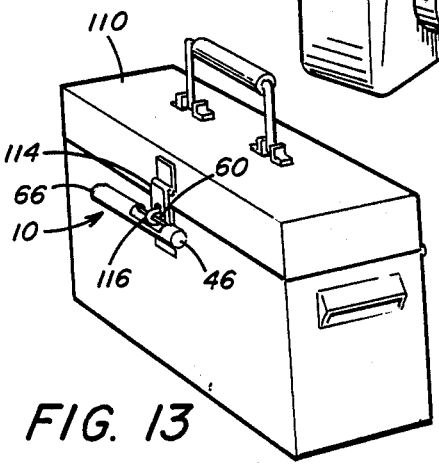
FIG. 13 is a perspective view of the locking device used to lock a toolbox.

FIGS. 12 and 13 are similar examples of use of the locking device 10 to secure, as shown in FIG. 12, a telephone 108 in a position to prevent its use and, as shown in FIG. 13, to secure a toolbox 110 from being opened. In order to prevent use of the telephone 108, the chain 70 is wrapped around the telephone cradle 112 and the telephone 108 thereon. As with the arrangement shown in FIG. 11, the choke 88 is advanced on the chain 70 to close the loop 94 tightly around the telephone 108 and the cradle 112. As above described, the choke 88 is secured to the locking device 10 in the locked position. This prevents the telephone 108 from being removed from the cradle 112 and being used.

In the example shown in FIG. 13, neither the chain 70 nor the choke 88 are used and are contained in the storage container 66 while the locking device 10 is used to secure the latch 114 in a closed position. This is accomplished by positioning the latch 114 over the eyelet 116 and then extending the locking pin 60 through the eyelet 116 and into the closed position, as above described, on the locking device 10.

Figure 14:
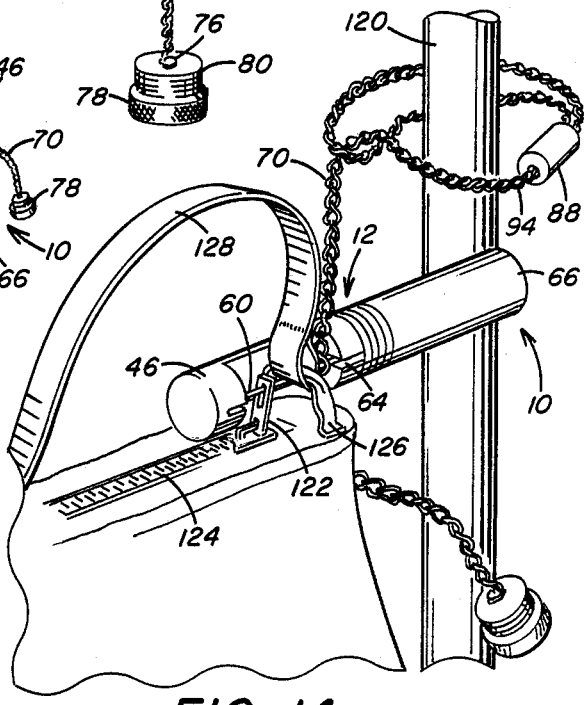
FIG. 14 is a fragmentary perspective view of a handbag locked in a closed position by the locking device, illustrating the chain extending around a fixed object and engaged by the pin in a locked position.

FIG. 14 illustrates another example of the use of locking device 10 to secure a handbag 118 to a stationary member 120, such as a post or the arm of a chair. In this application, the loop 94 is formed in the chain 70 and extended around the stationary member 120 as above described with regard to securing the camera 96 to the post 98 as shown in FIG. 10. The locking device 10 in the unlocked position is secured to the handbag 118 by extending the pin 60 through the opening in the zipper closure 122.

As shown in FIG. 14, the zipper 124 is, of course, first closed to seal the contents within the handbag 118. With the zipper 124 closed, the pin 60 is extended through the opening in the zipper closure 122 and also extended through a loop of material 126 which forms part of the strip 128 that is connected to the handbag 118. Pin 60 is then moved into the pin receiving recess 22 and the locking element 28 is locked to retain the pin 60 in the closed position.

With the above arrangement not only is the handbag 118 secured to the stationary object 120, but the handbag is also locked in a closed position. Of course, if there should be other satisfactory means of preventing the handbag or any similar object from being opened, it would not be necessary to lock it using the locking device 10. In this instance, the locking device 10 would be used to secure the handbag 118 to the stationary object 120 to prevent theft or unauthorized removal of the handbag 118 from the stationary object 120.

It should be understood that the locking device 10 of the present invention can be utilized to secure any number of small articles, such as those described above, or others which are too numerous to mention. The above examples are only representative of a few of the many applications of locking device 10 in accordance with the present invention.

According to the provisions of the patent statutes, we have explained the principle, preferred construction and mode of operation of our invention and have now illustrated and described what we now consider to represent its best embodiment. However, it should be understood that, within the scope of the appended claims, the invention may be practiced otherwise than as specifically illustrated and described.

We claim:

1. A locking device comprising:

a lock having a housing with a pin receiving recess formed therein;

a lock element slidably received within said lock housing, said lock element being movable relative to said lock housing between a locked position and an unlocked position, a pin housing connected to said lock element, a pin pivotally retained on said pin housing for movement between an open position and a closed position, said lock element being movable relative to said lock housing when said pin is in an open position, said lock element being fixed relative to said lock housing in said locked position when said pin is received within said pin receiving recess to lock said pin in a closed position, a length of chain for wrapping around a fixed object said chain being formed of a plurality of interconnecting links, a slide member having a longitudinal bore therethrough and a transverse longitudinal bore communicating with said bore, said chain extending through said longitudinal bore and from said slide member to form a loop extending from said slide member, and said pin in the closed position extending through said transverse bore to engage said chain within said slide member to secure said slide member to said pin housing.

2. A locking device comprising, a lock housing having a pin receiving recess formed in one end thereof, a lock element slidably received within said lock housing and movable relative to said lock housing between a locked position and an unlocked position, a pin housing connected to said lock element and spaced from said lock housing, a pin carried by said pin housing for movement between an open position and a closed position, said lock element together with said pin housing being movable relative to said lock housing for positioning of said pin in said pin receiving recess to secure said lock housing in the locked position and said pin in a closed position, a length of chain formed of a plurality of interconnecting links, a chain choke having a bore therethrough for receiving said chain, one end of said chain being secured to said chain choke and extending therefrom through said bore to form a loop of a preselected size extending from said chain choke, and means extending through said chain choke for engaging said chain in said bore to prevent movement of said chain in said bore to maintain the size of said loop extending from said chain choke.

3. A method for locking a lightweight portable object to a structure comprising the steps of:

securing a length of chain in a loop around the structure, advancing a slide member along the length of chain to close the loop to a preselected size around the structure, passing a lockable safety pin through an aperture in the object, passing the lockable safety pin through a bore of the slide member into engagement with a portion of the chain within the slide member, passing the lockable safety pin through at least one link of the chain positioned within the slide member, and thereafter locking the lockable safety pin to prevent slidable movement of the slide member on the chain to connect the chain to the safety pin and maintain the preselected size of the loop around the structure.

4. A locking device as set forth in claim 1 in which, said pin housing includes a body portion with a recess formed therein, said slide member receiving said pin in said transverse bore, and said slide member positioned within said recess when said pin is in said closed position to permit connection of said slide member to said pin housing.

5. A locking device as set forth in claim 1 which includes, a storage container connected to said lock element for receiving and storing said chain when not in use on said pin, said storage container including an open end portion positioned remote of said lock element to facilitate removal of said chain from said storage container, and means releasably connected to said open end for closing said container open end portion to securely contain said chain within said storage container when not in use.

6. A locking device as set forth in claim 5 in which, said container open end portion includes a threaded portion, and said means for closing said container open end portion includes a threaded cap for engaging said threaded portion to close said container open end portion.

7. A locking device as set forth in claim 5 which includes, means for connecting said chain to said means for closing said container open end portion to securely store said chain within said container and maintain said means for closing attached to said chain when in use.

8. A locking device as set forth in claim 7 which includes, means for connecting one end of said chain to said slide member and the opposite end of said chain to said means for closing said container.

9. A locking device as set forth in claim 1 in which, said pin housing has an opening for receiving one end of said lock element, and said lock element being pinned to said pin housing to permit movement of said pin housing with said lock element relative to said lock housing.

10. A locking device as set forth in claim 1 which includes, said pin extending through said slide member transverse bore to engage said chain to prevent movement of said slide member relative to said chain to maintain the size of said loop formed in said chain.

11. A locking device as set forth in claim 2 which includes, means for connecting said pin to said chain choke with said pin in the closed position to lock said choke to said pin housing.

12. A locking device as set forth in claim 11 in which, said means for connecting said pin to said chain choke includes a transverse bore extending through said chain choke for receiving said pin.

13. A locking device as set forth in claim 2 which includes, a transverse bore extending through said chain choke and communicating with said bore through said chain choke, and said pin extending through said transverse bore and engaging a portion of the chain extending through the bore in said chain choke to prevent movement of said chain in said bore and movement of said chain choke on said chain.

14. A locking device as set forth in claim 2 which includes, means connected to the second end of said chain to permit movement of substantially the entire length of said chain through said chain choke without said chain being removed therefrom.

15. A locking device as set forth in claim 2 which includes, means in said chain choke for receiving said pin to permit connection of said pin to said chain choke, and said pin housing having a recessed portion for receiving said chain choke mounted on said pin with said pin in the closed position.

16. A method as set forth through the slide member in a selected position on the chain, and locking the safety pin in a closed position to prevent movement of the slide member relative to the chain.

17. A method as set forth in claim 16 which includes, passing the safety pin in an open position through the slide member, engaging the lightweight portable object to the safety pin, and locking the safety pin to secure the lightweight portable object and the slide member on the safety pin.

18. A method as set forth in claim 3 which includes, positioning the loop formed in the chain around the structure, advancing the slide member on the chain into abutting relation with the structure to reduce the size of the loop and prevent removal of the loop from the structure, extending the safety pin through the bore of the slide member and into engagement with the chain in the slide member, and locking the safety pin to prevent movement of the slide member on the chain in a direction to increase the size of the loop.

19. A method as set forth in claim 3 which includes, extending the safety pin when in an open position through the lightweight portable object and the slide member, and pivoting the safety pin to a locked position to secure both the lightweight portable object and the slide member to the safety pin.

20. A method as set forth in claim 3 which includes, carrying the slide member on the safety pin for pivotal movement of the safety pin between an unlocked and locked position.

* * * * *

UNITED STATES PATENT AND TRADEMARK OFFICE

CERTIFICATE OF CORRECTION

PATENT NO. : 4,805,426

DATED : February 21, 1989

INVENTOR(S) : GARY S. DIMMICK, SCOTT G. LOCKERMAN

It is certified that error appears in the above-identified patent and that said Letters Patent is hereby corrected as shown below:

At [56] References Cited, Patent No. 599,765, change "3/1890" to --3/1898--.

Column 5, line 32, change "with in" to --within--.

Column 6, line 9, delete the first occurrence of "in" and after "chain" insert --70--.

Column 6, line 40, change "100" to --10--.

Column 7, line 26, change "strip" to --strap--.

Column 10, Claim 16, line 25, after "forth" insert --in claim 3 which includes, passing the safety pin--.

Signed and Sealed this

Fifteenth Day of August, 1989

*Attest:*

*Attesting Officer*

DONALD J. QUIGG

*Commissioner of Patents and Trademarks*